US011697198B2

(12) United States Patent
Mayr et al.

(10) Patent No.: US 11,697,198 B2
(45) Date of Patent: Jul. 11, 2023

(54) HAND-HELD POWER TOOL

(71) Applicant: Hilti Aktiengesellschaft, Schaan (LI)

(72) Inventors: Florian Mayr, Kaufbeuren (DE); Adrian Steingruber, Schwabmuenchen (DE); Katharina Marsiglia, Munich (DE); Vera Nübel, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 245 days.

(21) Appl. No.: 16/469,543

(22) PCT Filed: Dec. 6, 2017

(86) PCT No.: PCT/EP2017/081621

§ 371 (c)(1),
(2) Date: Jun. 13, 2019

(87) PCT Pub. No.: WO2018/108654

PCT Pub. Date: Jun. 21, 2018

(65) Prior Publication Data

US 2019/0308308 A1 Oct. 10, 2019

(30) Foreign Application Priority Data

Dec. 15, 2016 (EP) ..... 16204201

(51) Int. Cl.
*B25D 17/24* (2006.01)
*B25D 16/00* (2006.01)

(52) U.S. Cl.
CPC ..... *B25D 17/24* (2013.01); *B25D 16/00* (2013.01); *B25D 2211/068* (2013.01);
(Continued)

(58) Field of Classification Search
CPC .. B25D 16/00; B25D 17/24; B25D 2211/068; B25D 2222/57; B25D 2250/181;
(Continued)

(56) References Cited

U.S. PATENT DOCUMENTS 2,189,870 A * 2/1940 Sluyter ..... F16F 1/545 267/292
2,460,829 A * 2/1949 Ivanovie ..... F16F 1/374 267/140.2

(Continued)

FOREIGN PATENT DOCUMENTS

CN 101011821 A 8/2007
CN 104209929 A 12/2014

(Continued)

OTHER PUBLICATIONS

International Search Report of PCT/EP2017/081621, dated Feb. 26, 2018.

*Primary Examiner* — Robert F Long
*Assistant Examiner* — Eduardo R Ferrero
(74) *Attorney, Agent, or Firm* — Davidson, Davidson & Kappel, LLC

(57) ABSTRACT

A hand-held power tool includes a tool holder for holding a chiseling tool, a machine housing (16), and a striking mechanism (12) including a striking body (22) moved on a longitudinal axis (5) for exerting strikes on the tool in an impacting direction. A damper (23) is used for stopping the striking body (22). The damper (23) includes a ring made up of multiple elastic beads situated along a circumferential direction around the longitudinal axis (5).

20 Claims, 5 Drawing Sheets

(52) U.S. Cl.
CPC .. *B25D 2217/0073* (2013.01); *B25D 2222/57* (2013.01); *B25D 2250/181* (2013.01); *B25D 2250/321* (2013.01); *B25D 2250/345* (2013.01)

(58) Field of Classification Search
CPC ..... B25D 2250/321; B25D 2250/345; B25D 2217/0073; F16F 1/34; F16F 1/36; F16F 1/373; F16F 1/374; F16F 1/545; F16F 2232/08; F16F 2236/04; F16F 2236/046; F16F 2236/123; F16F 3/08; F16F 3/087; F16F 15/04; F16F 15/08; F16F 15/12; F16F 2238/04; F16F 1/375; F16F 2234/08; B24D 16/00; Y10T 152/10441
See application file for complete search history.

(56) References Cited

U.S. PATENT DOCUMENTS 2,462,011 A * 2/1949 Thiry ..... F16F 1/54 384/220
2,468,901 A * 5/1949 Thiry ..... F16F 1/54 267/140.3
2,712,742 A * 7/1955 Neidhart ..... F16F 1/545 464/83
2,729,442 A * 1/1956 Neidhart ..... F16F 1/545 267/257
2,819,060 A * 1/1958 Neidhart ..... F16F 1/545 267/153
2,819,063 A * 1/1958 Neidhart ..... F16F 3/0876 267/292
3,391,892 A * 7/1968 Neidhart ..... F16F 1/545 267/141.7
3,687,479 A * 8/1972 Kober ..... B60G 11/60 280/124.13
4,336,848 A * 6/1982 Wanner ..... B25D 17/04 173/210
4,385,665 A * 5/1983 Knoll ..... B25D 17/24 173/162.1
4,517,854 A * 5/1985 Kawabata ..... B62D 1/16 280/780
4,936,394 A * 6/1990 Ohtsu ..... B24B 23/005 173/162.2
5,005,811 A * 4/1991 Harrison ..... B60G 13/003 267/220
5,213,167 A * 5/1993 Best ..... B25D 17/043 173/162.2
5,330,165 A * 7/1994 van Goubergen ..... F16F 1/374 267/141
5,335,995 A * 8/1994 Villar ..... F16F 1/374 248/634
5,400,860 A * 3/1995 Best ..... B25D 17/24 173/162.2
6,889,778 B2 * 5/2005 Colangelo, III ..... B25B 21/02 173/93
7,614,460 B2 * 11/2009 Henriksson ..... B25D 17/24 173/109
9,272,408 B2 3/2016 Kovh et al.
2002/0125652 A1 * 9/2002 Hanke ..... B25D 17/06 279/19.4
2002/0185002 A1 * 12/2002 Herrmann ..... F04B 53/22 92/129
2007/0034398 A1 * 2/2007 Murakami ..... B25B 21/02 173/128
2007/0158886 A1 * 7/2007 Gedenk ..... A61P 31/04 267/64.21
2007/0179328 A1 8/2007 Murakami et al.
2007/0289762 A1 * 12/2007 Kikukchi ..... B25D 17/043 173/162.1
2008/0188316 A1 * 8/2008 Takamura ..... F16F 1/545 464/30
2008/0283260 A1 11/2008 Kramer et al.
2009/0013814 A1 * 1/2009 Geiberger ..... F16F 1/373 74/470
2011/0100665 A1 * 5/2011 Nakashima ..... B25F 5/026 173/162.2
2012/0125650 A1 * 5/2012 Koch ..... B25D 17/06 173/211
2014/0352994 A1 12/2014 Yoshikane et al.
2015/0250088 A1 * 9/2015 Sandberg ..... F16F 1/545 172/705
2015/0266176 A1 9/2015 Takeuchi et al.
2018/0361551 A1 * 12/2018 Hartmann ..... B25D 11/125

FOREIGN PATENT DOCUMENTS

DE 2140728 A1 * 2/1972 ..... F16F 1/374
DE 102008001957 12/2009
EP 1987-015998 * 6/1986 ..... F16F 1/373
EP 1987926 11/2008
EP 2266762 12/2010
EP 2452784 5/2012
GB 2262467 6/1993
JP 55065739 A * 5/1980 ..... F16F 1/545
JP 2015182167 A 10/2015

* cited by examiner

HAND-HELD POWER TOOL

AREA OF THE INVENTION

The present invention relates to a hand-held power tool having a striking mechanism.

BACKGROUND

A hand-held power tool including a striking mechanism is known, for example, from EP 1987926 A2. The striking mechanism includes a free-floating beater, which is moved forward and back via an electropneumatic drive. The beater strikes on an intermediate beater, which transmits the strike to a drill or chisel. The intermediate beater rebounds from the drill after the strike. The backward movement of the intermediate beater is stopped by a rebound impact damper. The rebound impact damper contains a toroidal elastic ring, which dampens the impact of the intermediate beater in the rebound impact damper.

SUMMARY OF THE INVENTION

The present invention provides a hand-held power tool including a tool holder for holding a chiseling tool, a machine housing, and a striking mechanism having a striking body moved on a longitudinal axis, for exerting strikes on the tool in an impacting direction. A damper is used for stopping the striking body. The damper includes a ring made of multiple elastic beads situated along a circumferential direction around the longitudinal axis. The beads enable flowing of the material in the circumferential direction. The damping behavior tends less strongly toward chambers in comparison to a rotationally-symmetrical sealing ring.

The beads each include a first front side pointing in the impacting direction and a second front side pointing against the impacting direction. In one design, one or both of the front sides is/are inclined along the circumferential direction in a plane which is perpendicular to the longitudinal axis. The inclined front sides may in particular be concavely curved in the circumferential direction.

One design provides that one or both of the concavely curved front sides are rotational ellipsoidal. The front side may be a spherical cap of a spheroid. The entire bead may be spheroidal. A rotational axis of the spheroid is tangential to a circumferential direction of the ring. In one special design, the bead is a sphere.

The centers of gravity of adjacent beads in the circumferential direction are situated at a distance. In one design, the concavely curved front side has a radius of curvature along the circumferential direction which is between 25% and 100% of the distance.

Under a force effect of the striking body on the damper, one of the front sides rests with its contact surface indirectly or directly on the machine housing and the other of the front sides rests with its contact surface indirectly or directly on the striking body. One design provides that the contact surface of the at least one, preferably concavely curved front side increases with increasing force effect. The front side rests more strongly with increasing force and spring deflection, whereby the restoring force increases disproportionately in relation to the spring deflection. One design provides that the contact surface of the concavely curved front side increases at least proportionally to the spring deflection.

One design provides that the centers of gravity of the beads are located in one plane. The first front sides of all beads may be located in one plane. The second front sides of all beads may be located in another plane.

A center of the first front side and a center of the second front side are preferably located on an axis parallel to the longitudinal axis. The front sides of each bead are opposite to one another along the longitudinal axis and thus the force effect. The front sides of the beads overlap completely along the circumferential direction.

The grouping of the cross sections in planes, which contain the longitudinal axis, through the bead, includes a minimal cross section and a maximal cross section. One design provides that the surface area of the minimal cross section is between 20% and 50% of the surface area of the maximal cross section.

The grouping of the cross sections in planes, which contain the longitudinal axis through the bead, includes a maximal cross section and a minimal cross section. In a projection along the circumferential direction of the minimal cross section on the maximal cross section, the minimal cross section is located within the maximal cross section and a ring-shaped closed section of the maximal cross section is located outside the minimal cross section. The bead becomes thinner from the thickest point, i.e., with the maximal cross section along the circumferential direction, in every direction perpendicular to the circumferential direction.

BRIEF DESCRIPTION OF THE DRAWINGS

The following description explains the present invention on the basis of exemplary specific embodiments and figures.

Identical or functionally-identical elements are indicated by identical reference numerals in the figures if not indicated otherwise.

DETAILED DESCRIPTION OF THE INVENTION

Figure 1:
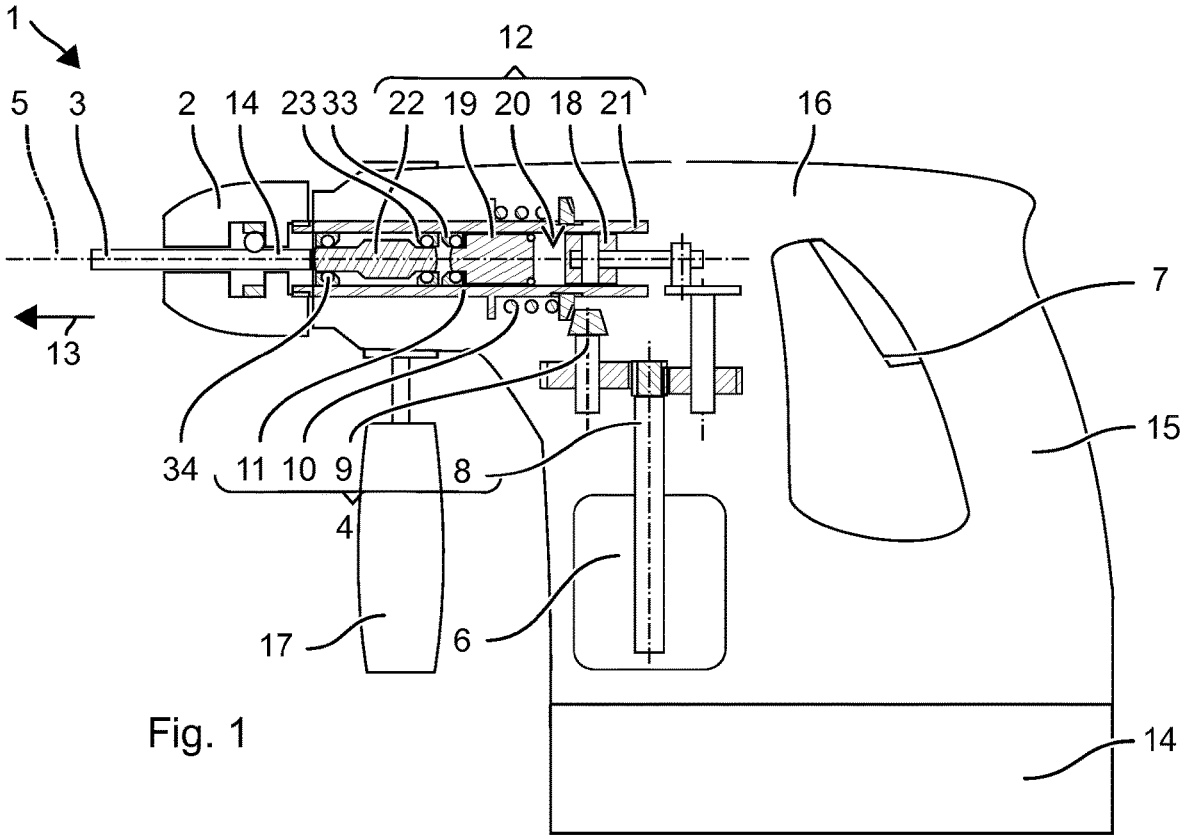
FIG. 1 shows a hammer drill

FIG. 1 schematically shows a hammer drill 1 as an example of a hand-held power tool. Hammer drill 1 includes a tool holder 2, into which a drill 3 or another tool may be inserted and locked. Exemplary hammer drill 1 includes a rotary drive 4, which drives tool holder 2 to rotate around its working axis 5. Rotary drive 4 is based on electric motor 6, which the user may turn on and off via an operating button 7. Exemplary rotary drive 4 is rigidly coupled to tool holder 2. Exemplary rotary drive 4 includes a (motor) shaft 8, a step-down gear 9, a slip clutch 10, and an output shaft 11. A striking mechanism 12 strikes periodically in an impacting direction 13, along working axis 5, on drill 3. Striking mechanism 12 is preferably driven by the same electric motor 6. A power supply may take place by a battery 14 or a power cable. Hammer drill 1 includes a handle 15, which is typically fastened on an end of a machine housing 16 of hammer drill 1 facing away from tool holder 2. An additional handle 17 may be fastened close to tool holder 2, for example.

Striking mechanism 12 is a pneumatic striking mechanism. An exciter piston 18 is forced by electric motor 6 into a periodic forward and back movement along working axis 5. A beater 19 running on working axis 5 is coupled via an air spring to exciter piston 18. The air spring is formed by a pneumatic chamber 20 closed by exciter piston 18 and beater 19. Exciter piston 18 and beater 19 may be guided in an upright guide tube 21, which also closes pneumatic chamber 20 in the radial direction. In alternative embodiments, the exciter piston is designed as cup-shaped having a cylindrical cavity. The beater is guided in the cylindrical cavity. Pneumatic chamber 20 is again closed by beater 19 and exciter piston 18 along working axis 5, exciter piston 18 also closing pneumatic chamber 20 in the radial direction. In another embodiment, the beater is designed as cup-shaped and the exciter piston is guided in the cylindrical cavity of the beater.

Striking mechanism 12 may include an anvil 22, which transmits the striking energy of beater 19 to drill 3. Anvil 22 is situated directly behind beater 19 in impacting direction 13. Anvil 22 is located essentially in front of tool holder 2 in impacting direction 13. When the drill is pressed against the substrate, drill 3 and thus indirectly anvil 22 are displaced against impacting direction 13 until anvil 22 rests against a rebound impact damper 23. The position of anvil 22 assumed on rebound impact damper 23 is referred to hereafter as the working position of anvil 22 or working position of the striking mechanism, since beater 19 preferably strikes on anvil 22 when it is in or close to the working position. Measures are typically provided for deactivating striking mechanism 12 if anvil 22 comes to rest outside the working position.

Figure 2:
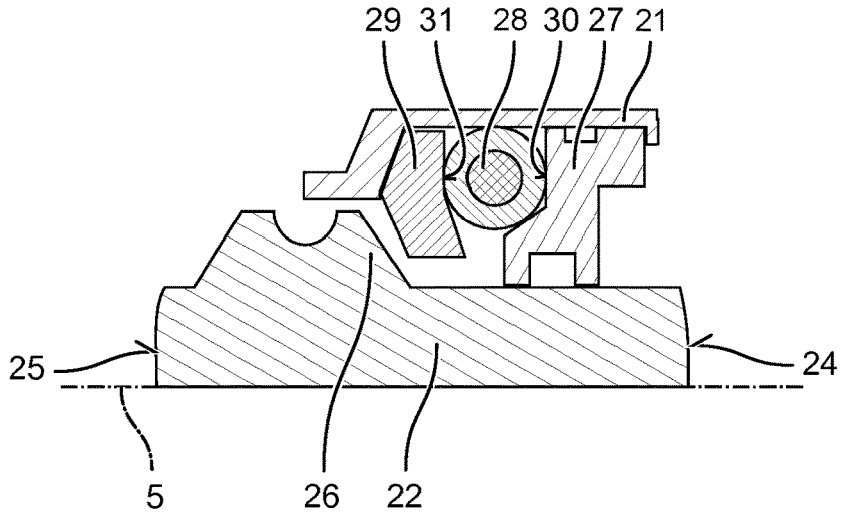
FIG. 2 shows a rebound impact damper

FIG. 2 shows a partial section through an exemplary anvil 22 and rebound impact damper 23. Anvil 22 is essentially a rotationally-symmetrical solid body having an impacting surface 24 facing toward beater 19 for absorbing a strike from beater 19 and a tool-side impacting surface 25 for delivering a strike to drill 3. Impacting surfaces 24, 25 are typically approximately equal in size. Anvil 22 has a ring-shaped shoulder 26, which protrudes in the radial direction beyond impacting surfaces 24, 25. Shoulder 26 is used for stopping anvil 22 on rebound impact damper 23.

Rebound impact damper 23 is formed ring-shaped and encloses anvil 22. Rebound impact damper 23 only overlaps in the radial direction with ring-shaped shoulder 26 of anvil 22. Beater 19 has unobstructed access to impacting surface 24. An internal diameter of rebound impact damper 23 is larger than the diameter of anvil 22 on impacting surface 24 and smaller than the diameter of anvil 22 on shoulder 26.

A longitudinal axis 5 of rebound impact damper 23 is coincident with working axis 5 of striking mechanism 12. Rebound impact damper 23 includes a seat 27, an elastic damping ring 28, and preferably a protective disk 29. Seat 27 is situated fixed in machine housing 16. Damping ring 28 rests with its front end side 30 on seat 27 against impacting direction 13. Anvil 22 may be supported with its shoulder 26 on rear end side 31 of damping ring 28. Protective disk 29, which is movable in relation to machine housing 16, may be situated between rear end side 31 and anvil 22. Protective disk 29 improves a uniform force application from anvil 22 into damping ring 28 and reduces the wear of damping ring 28. Protective disk 29 overlaps in the radial direction with shoulder 26 of anvil 22 and preferably not with its impacting surface 24.

Rebound impact damper 23 dissipates damped excess kinetic energy of anvil 22 into machine housing 16. After anvil 22 has struck drill 3, anvil 22 flies against impacting direction 13. Anvil 22 is stopped by rebound impact damper 23. Rebound impact damper 23 dampens the impact by elastically compressing damping ring 28 of rebound impact damper 23. The shortening of the longitudinal dimension of damping ring 28 during the compression is referred to as spring deflection. Protective disk 29 can stop at seat 27 to limit the spring deflection to a maximum spring deflection. The stop protects damping ring 28 from overstress. Damping ring 28 may be pre-tensioned between protective disk 29 and seat 27 along working axis 5.

The damping function of rebound impact damper 23 is implemented by elastic damping ring 28. Damping ring 28 is a dimensionally-stable ring made of an elastic material. Damping ring 28 is elastically deformed by anvil 22 without a plastic deformation remaining, at least for the provided maximum spring deflection. Damping ring 28 resumes its basic form as soon as force is no longer applied thereto. The elastic material of damping ring 28 is soft in comparison to the other materials of the striking mechanism, in particular to the steel used for the striking bodies, i.e., beater 19 and anvil 22, and the more brittle plastics for the housing of hammer drill 1. The modulus of elasticity is, for example, less than 10 GPa (gigapascals). Damping ring 28 is made, for example, of natural or synthetic rubber, for example, 70 HNBR.

Striking mechanism 12 may include further dampers. For example, a damper 33 is situated in front of beater 19 in impacting direction 13. Damper 33 stops beater 19 in impacting direction 13 if anvil 22 is not in the working position. Furthermore, a damper 34 may be provided for stopping anvil 22 in impacting direction 13. The dampers preferably include an elastic damping ring.

Figure 3:
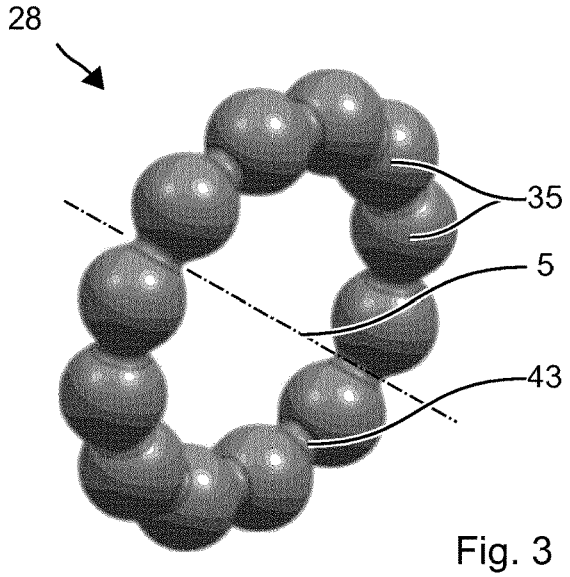
FIG. 3 shows a damping ring in a perspective view
Figure 4:
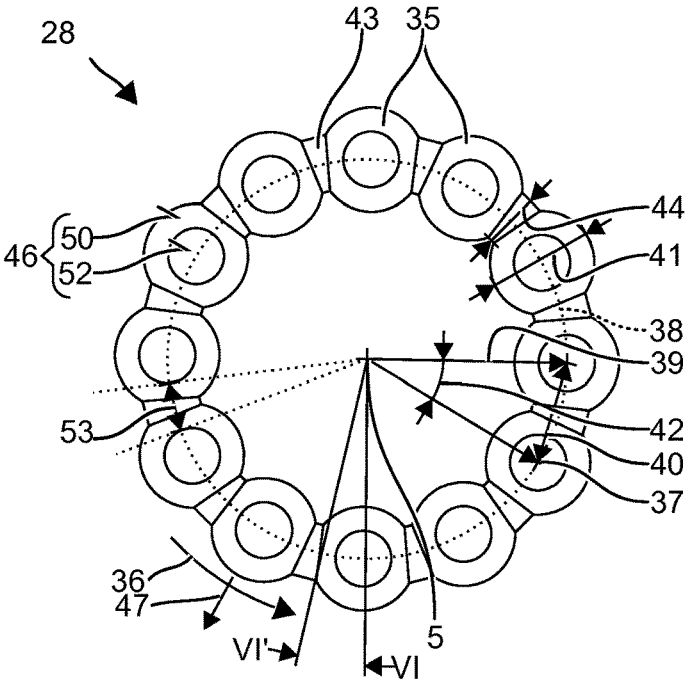
FIG. 4 shows a top view of the damping ring

Damping ring 28 is formed from multiple elastic beads 35, which are situated to form a ring 28. An exemplary damping ring 28 is shown in a perspective view in FIG. 3, a top view in FIG. 4, and a side view in FIG. 5. The side view shows damping ring 28 unrolled along circumferential direction 36, i.e., a cylindrical projection.

Illustrated damping ring 28 has twelve identical spherical beads 35. Damping ring 28 has a twelve-fold rotational symmetry. Centers of gravity or center points 37 of beads 35 are located on a planar circular line 38 in plane E, which is perpendicular to longitudinal axis 5. Beads 35 are situated at equal radius 39 in relation to longitudinal axis 5. Beads 35 are distributed uniformly in circumferential direction 36 around longitudinal axis 5, i.e., on circular line 38. (Center point) distances 40 between center points 37 of adjacent beads 35 are equal. Adjacent beads 35 preferably touch one another. Center point distance 40 between adjacent beads 35 approximately corresponds to diameter 41 of beads 35. Angle 42 viewed from longitudinal axis 5 between adjacent beads 35 is 30°, i.e., one-twelfth of the circle circumference. Elastic bridges 43 may connect adjacent beads 35. Alternatively, beads 35 may be connected by a cord or may be inserted loosely. Bridges 43 are segments of a torus, whose major radius corresponds to radius 39 and whose minor radius 44 corresponds to approximately one-fourth of diameter 41 of beads 35.

Beads 35 each have a front end side 45 pointing against impacting direction 13 and a rear end side 46 pointing in impacting direction 13. Front sides 45, 46 are spherical-cap-shaped or dome-shaped in accordance with the shape of beads 35.

Figure 6:
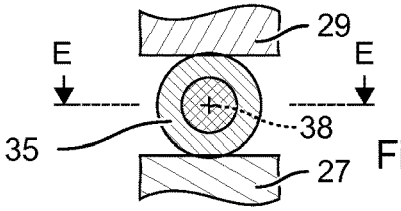
FIG. 6 shows a superimposed view of the sections in plane VI and plane VI'

Spherical cap-shaped front side 46 is convexly curved along radial direction 47 and convexly curved along circumferential direction 36. The circumferential curvature of front side 46, i.e., the curvature along radial direction 47, may be seen in a section through bead 35, the sectional plane containing longitudinal axis 5. The sectional figure is a circle (FIG. 6). A radial inclination of front side 46, i.e., its inclination in relation to plane E along radial direction 47, decreases continuously with increasing distance from plane E.

Figure 5:
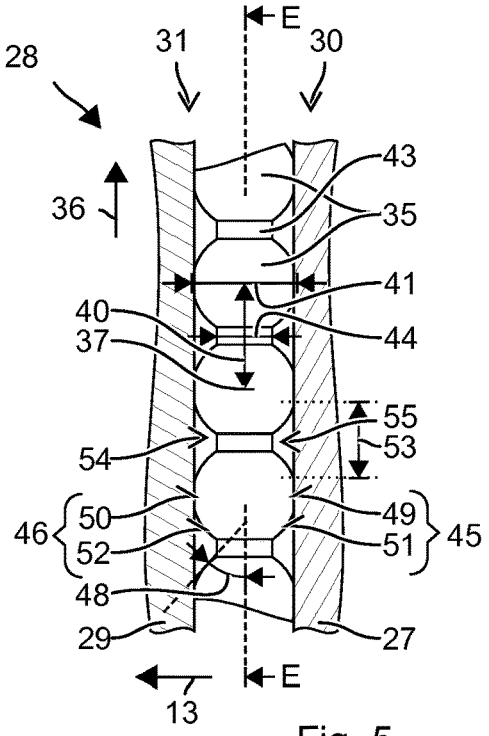
FIG. 5 shows a cylindrical projection of a side view of the damping ring

The circumferential curvature of front side 46 of bead 35, i.e., the curvature along circumferential direction 36, is apparent in FIG. 5. FIG. 5 shows a side view of damping ring 28 in a cylindrical projection. A circumferential inclination 48 of front side 46, i.e., its inclination in relation to plane E along circumferential direction 36, decreases continuously with increasing distance from adjacent beads 35. Front end side 45 of bead 35 is formed mirror-symmetrical to rear end side 46 in relation to plane E. Rear end side 46 also has a convex radial curvature and a convex circumferential curvature. Its radial inclination and its circumferential inclination behave similarly to rear end side 46.

Front sides 45, 46 of beads 35 essentially form front sides 30, 31 of damping ring 28. Beads 35 are situated successively along circumferential direction 36. The circumferential inclination of rear end side 31 of damping ring 28 oscillates along circumferential direction 36 between a maximum, which is present at or close to the transition between two adjacent beads 35, and a minimum, which is present at the middle of bead 35. The inclination changes continuously. The minimum is approximately 0°. The maximum is, for example, between 60° and 90°. The transition from the minimum to the maximum takes place over a substantial portion of the front side, for example, over at least one-fourth of the center point distance 40 of two adjacent beads 35. A radius of curvature of curved front side 45 corresponds to half of the diameter of bead 35. The circumferential inclination of front end side 30 of damping ring 28 behaves mirror-symmetrically in relation to rear end side 31.

The cord diameter of damping ring 28 refers to the diameter of the sectional figure which results due to the section of damping ring 28 with a plane containing longitudinal axis 5. The cord diameter of damping ring 28 oscillates along circumferential direction 36 between a maximum and a minimum. The maximum results for plane VI through the center point of bead 35. The maximum cord diameter is equal to diameter 41 of bead 35. The minimum results for plane VI' through bridge 43 or the middle between two adjacent beads 35. The minimum cord diameter is equal to diameter 44 of bridge 43. The maximal cross section from plane VI and the minimal cross section from plane VI' are shown superimposed in a projection along circumferential direction 36 in FIG. 6. The minimal cross section is located completely within the larger maximal cross section. The maximal cross section has a ring-shaped section, which, located outside the minimal cross section, encloses it in a ring shape. The edges of the two cross sections do not touch. The transition from the minimum to the maximum takes place over a substantial portion of the front side, for example, over at least one-fourth of center point distance 40 of two adjacent beads 35. Preferably, all projected cross sections of bead 35, in particular in the transition, are located completely within the maximum cross section.

Convex front sides 45, 46 only rest with a part on seat 27 and protective disk 29. The resting part of front end side 45 is referred to as front contact surface 49 and the resting area of rear end side 46 is referred to as rear contact surface 50. The other areas are referred to as exposed areas 51, 52. Front sides 45, 46 are elastically deformed at contact surfaces 49, 50. Contact surfaces 49, 50 essentially correspond to the surface of seat 27 or protective disk 29. In the illustrated example, front contact surfaces 49 are planar. Front contact surfaces 49 of individual beads 35 rest jointly in a plane parallel to plane E on seat 27. Rear contact surfaces 50 are planar. Rear contact surface 50 of individual beads 35 rests jointly in a plane parallel to plane E on protective disk 29. Front contact surface 49 and rear contact surface 50 of bead 35 overlap in circumferential direction 36. The area center points of the two contact surfaces 49, 50 are located on an axis parallel to longitudinal axis 5.

The relative surface area of rear contact surface 50 in relation to the surface area of rear end side 46 is dependent on the contact pressure force of damping ring 28 on seat 27. The relative surface area of rear contact surface 50 increases continuously with increasing contact pressure force. Similarly, the relative surface area of rear contact surface 50 increases continuously with increasing contact pressure force.

Contact surfaces 50 of adjacent beads 35 are spaced apart. Distance 53 between contact surfaces 50 in unloaded damping ring 28 is approximately equal to center point distance 40 of two adjacent beads 35. Distance 53 decreases with increasing contact pressure force. Distance 53 is less than half of center point distance 40 at the maximum spring deflection and is preferably greater than one-fourth of center point distance 40. The distance changes similarly between front contact surfaces 49.

Exposed areas 51, 52 of front sides 45, 46 are convexly curved as predefined by the shape of beads 35. The convex curvature in radial direction 47 and circumferential direction 36 is also maintained during the compression. The properties with respect to changing inclination 48 and the cord diameter are retained during the compression.

Exposed areas 52 of adjacent beads 35 inclined in relation to plane E have a protective disk 29 that closes a cavity 54. Cavity 54 widens with increasing distance 40 from plane E in a funnel shape in circumferential direction 36. Similarly, funnel-shaped cavities 55 result at front end side 30 of damping ring 28. Without external force and compression, the ratio of the volume of damping ring 28 to the total volume of cavities 54, 55 is between 2:3 and 3:2. Cavities 54, 55 are assumed to be delimited in radial direction 47 and in the longitudinal direction by the corresponding radial and axial dimensions of the damping ring 28. During the compression of damping ring 28, cavities 54, 55 are partially filled with material deformed along circumferential direction 36.

Beads 35 are preferably solid bodies made of the elastic material. The elastic material of beads 35 is soft in comparison to the other materials of the striking mechanism, in particular the steel used for the striking bodies, i.e., beater 19 and anvil 22, and the rather brittle plastics for the housing of hammer drill 1. The modulus of elasticity is, for example, less than 10 GPa (gigapascals). Beads 35 are made, for example, of natural or synthetic rubber, for example, 70 HNBR.

Damping ring 28 includes twelve beads 35 in the illustration. The number is only by way of example. Damping ring 28 preferably has between eight and twenty beads 35. Radius 39 of damping ring 28 is in the range between 1.5 times and 4 times diameter 41 of beads 35. Adjacent beads 35 may partially overlap. If beads 35 do not overlap or do not overlap sufficiently for a stable connection, bridges 43 may be provided. Bridges 43 are preferably made of the same material as beads 35. The volume and the surface area of bridges 43 may be negligible in relation to beads 35. For example, their fraction of the surface area is less than 10%.

Figure 7:
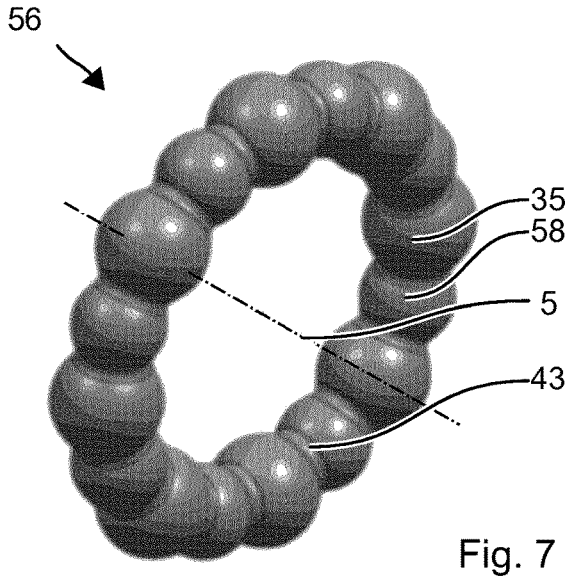
FIG. 7 shows a further damping ring in a perspective view
Figure 8:
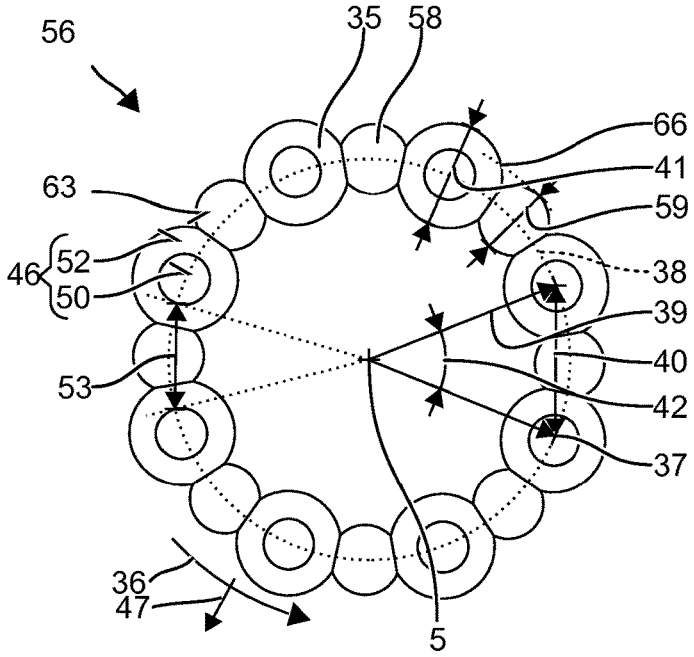
FIG. 8 shows a top view of the damping ring
Figure 9:
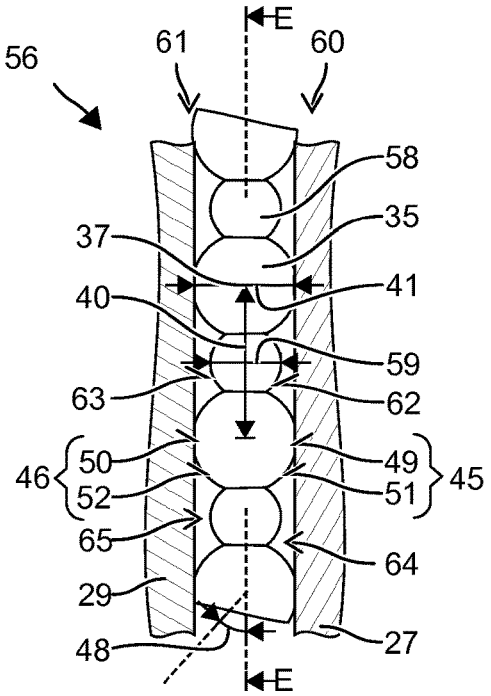
FIG. 9 shows a cylindrical projection of a side view of the damping ring

A damping ring 56 is formed from multiple elastic beads 35, which are situated to form a ring 57. An exemplary damping ring 56 is shown in a perspective view in FIG. 7, a top view in FIG. 8, and a side view in FIG. 9. The side view shows damping ring 56 unrolled along circumferential direction 36, i.e., a cylindrical projection.

Illustrated damping ring 56 has eight identical spherical larger beads 35 and eight identical spherical smaller beads 58. Damping ring 28 has an eight-fold rotational symmetry around longitudinal axis 5. Larger beads 35 and smaller beads 58 are situated alternately along a planar circular line 38. Center points 37 of larger beads 35 and smaller beads 58 are located on circular line 38 in plane E. Center point distances 40 between center points 37 of adjacent larger beads 35 are equal. Smaller bead 58 is located in each case in the middle between adjacent larger beads 35. Diameter 41 of larger beads 35 is approximately 1.5 times diameter 59 of smaller bead 35. Large beads 35 and small beads 58 overlap along circumferential direction 36 and are thus connected. Center point distance 40 between adjacent large beads 35 is between 10% and 20% less than the total over diameter 41 of large bead 35 and diameter 59 of smaller bead 58.

Front end side 60 and rear end side 61 of damping ring 56 are essentially formed by front end sides 45 of larger beads 35 and front end sides 62 of smaller beads 58 or by rear end sides 46 of larger beads 35 and rear end sides 63 of smaller beads 58, respectively.

Larger beads 35 rest on both sides with their front end sides 45 and their rear end sides 46 on seat 27 and on protective disk 29. Larger beads 35 may rest on both sides on seat 27 and protective disk 29 without compression. Reference is made to the preceding exemplary embodiment for the description of resting contact surfaces 49, 50 and their behavior under an external force.

Smaller beads 58 do not rest with their front end side 62 or their rear end side 63 on seat 27 and on protective disk 29, without external force. Smaller beads 58 first come to rest when larger beads 35 are compressed under the influence of an external force. The spring deflection required for this purpose corresponds to the difference of diameter 41 of larger beads 35 and diameter 59 of smaller beads 58.

The front sides of large beads 35 and small beads 58 are all spherical-cap-shaped. The front sides are inclined in radial direction 47 and circumferential direction 36 in relation to plane E. The circumferential inclination of rear end side 63 of damping ring 56 oscillates along beads 35, 58. Inclination 48 preferably changes continuously. Inclination 48 is minimal above center points 37 of larger beads 35 and smaller beads 58 and maximal in the transition area between larger bead 35 to smaller bead 58. The minimum is approximately 0°. The maximum is, for example, between 60° and 90°. The transition from the minimum to the maximum takes place over a substantial portion of the front side, for example, over at least one-fourth of center point distance 40 of two adjacent large beads 35.

The cord diameter of damping ring 56 varies along circumferential direction 36 between the absolute maximum specified by diameter 41 of larger beads 35, a local maximum specified by diameter 59 of smaller beads 35, and a minimum specified by the transition areas between larger beads 35 and smaller beads 58. The cord diameter changes continuously, i.e., without jumps. Larger bead 35 has a cord diameter, which corresponds to diameter 59 of smaller bead 58, at a point 66 along circumferential direction 36. The distance along circumferential direction 36 of this point 66 from center point 37 is greater than one-fifth of center point distance 40 between adjacent large beads 35.

Front sides 60, 63 of damping ring 56 close cavities 64 and cavities 65 with seat 27 and protective disk 29. Cavities 64, 65 may be made comparatively large with the aid of smaller beads 58. Without external force and compression, the ratio of the volume of damping ring 56 to the total volume of cavities 64, 65 is between 1:3 and 2:3. Cavities 54, 55 are assumed to be delimited in radial direction 47 and in the longitudinal direction by the corresponding radial and axial dimensions of damping ring 28.

The total number of larger beads 35 and smaller beads 58 is by way of example. Alternatively, between six and twelve larger beads 35 and between six and twelve smaller beads 58 may be used. The total number is dependent on the diameter of damping ring 56. The number of larger beads 35 and smaller beads 58 is preferably equal. The size ratio of larger beads 35 to smaller beads 58 may be selected as a function of the desired stiffness or by which spring deflection the smaller beads 58 contribute to the rigidity.

Figure 10:
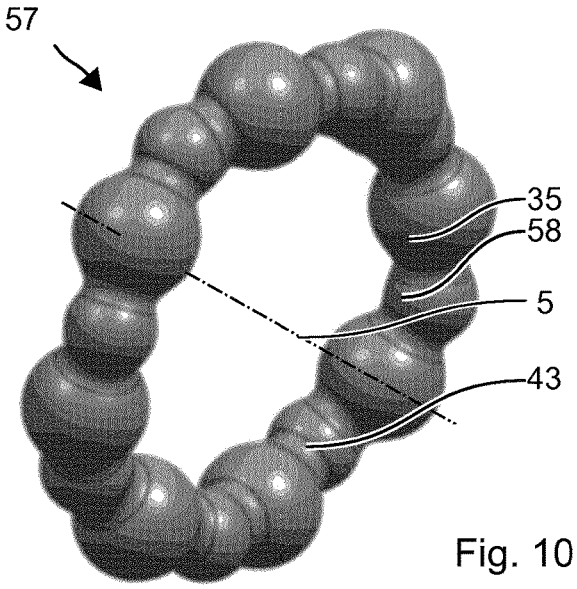
FIG. 10 shows a further damping ring in a perspective view
Figure 11:
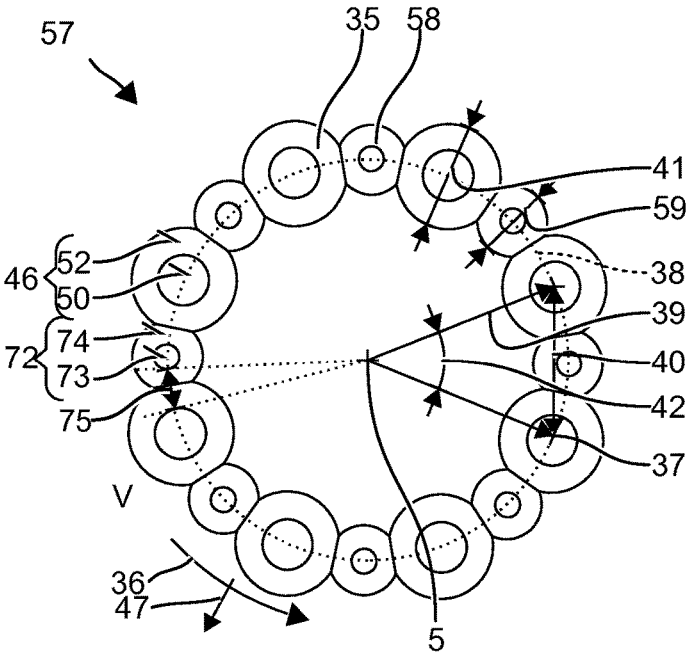
FIG. 11 shows a top view of the damping ring
Figure 12:
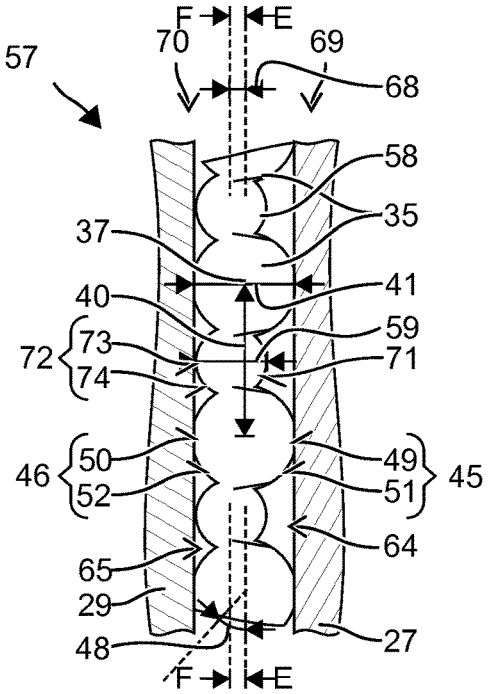
FIG. 12 shows a cylindrical projection of a side view of the damping ring

A damping ring 57 is formed from multiple elastic beads 35 which are situated to form a ring 57. An exemplary damping ring 57 is shown in a perspective view in FIG. 10, a top view in FIG. 11, and a side view in FIG. 12. The side view shows damping ring 57 unrolled along circumferential direction 36, i.e., a cylindrical projection.

Illustrated damping ring 57 includes eight identical spherical larger beads 35 and eight identical spherical smaller beads 58. Damping ring 28 has an eight-fold rotational symmetry around longitudinal axis 5. Larger beads 35 and smaller beads 58 are situated alternately along a planar circular line 38. Center points 37 of larger beads 35 are located on a first planar circular line 38 in plane E and smaller beads 58 are located on a second planar circular line in plane F. First circular line 38 is offset along working axis 5 in relation to second circular line 67. Offset 68 between the two planes E, F is equal to or less than the difference of diameter 41 of large beads 35 from diameter 59 of smaller beads 58. Center point distances 40 between center points 37 of adjacent large beads 35 are equal. Smaller bead 58 is located in each case in the middle between adjacent larger beads 35. Diameter 41 of larger beads 35 is approximately 1.5 times diameter 59 of smaller bead 35. Large beads 35 and small beads 58 overlap along circumferential direction 36 and are thus connected. Center point distance 40 between adjacent large beads 35 is between 10% and 20% less than the total over diameter 41 of large bead 35 and diameter 59 of smaller bead 58.

Front end side 69 and rear end side 70 of damping ring 56 are essentially formed by front end sides 45 of larger beads 35 and front end sides 71 of smaller beads 58 or by rear end sides 46 of larger beads 35 and rear end sides 72 of smaller beads 58, respectively.

Larger beads 35 rest on both sides with their front end sides 45 and their rear end sides 46 on seat 27 and on protective disk 29. Larger beads 35 may rest without compression on both sides on seat 27 and protective disk 29. Reference is made to the preceding exemplary embodiment for the description of resting contact surfaces 49, 50 and their behavior under an external force.

Smaller beads 58 rest on one side with, for example, rear end side 72 on protective disk 29. Other front side 71 is spaced apart from seat 27. During a compression of damping ring 56, initially only one front side 72 is deformed. Front side 72 includes a corresponding contact surface 73 and exposed areas 74, which behave similarly to contact surfaces 50 and exposed areas 52 of large bead 35. Contact surfaces 50 of larger beads 35 and contact surfaces 49 of smaller beads 58 do not overlap, but rather are separated by a distance 75 in circumferential direction 36. Distance 75 decreases with increasing compression.

The total number of larger beads 35 and smaller beads 58 is by way of example. Alternatively, between six and twelve larger beads 35 and between six and twelve smaller beads 58 may be used. The total number is dependent on the diameter of damping ring 56. The number of larger beads 35 and smaller beads 58 is preferably equal. The size ratio of larger beads 35 to smaller beads 58 may be selected as a function of the desired rigidity or by which spring deflection the smaller beads 58 contribute to the rigidity with both front sides.

Figure 13:
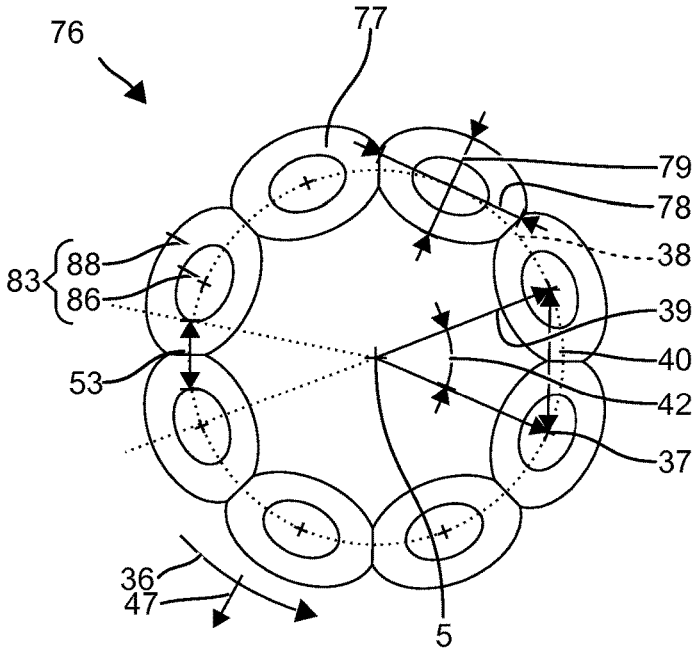
FIG. 13 shows a top view of a further damping ring
Figure 14:
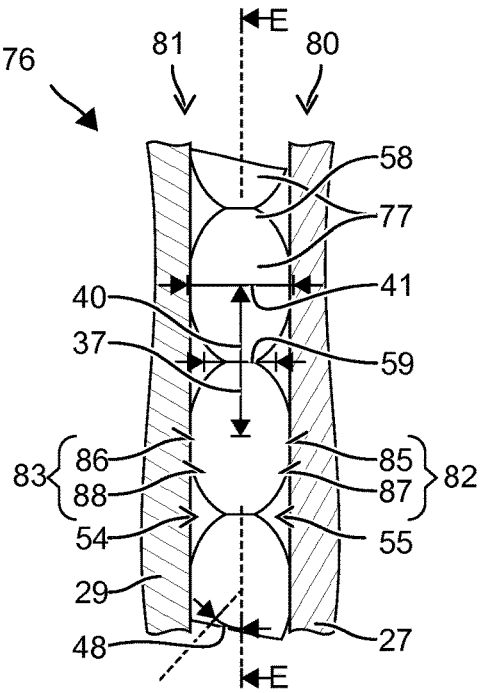
FIG. 14 shows a cylindrical projection of a side view of the damping ring

A damping ring 76 is formed from multiple elastic beads 77, which are situated to form a ring 76. An exemplary damping ring 76 is shown in a top view in FIG. 13 and in a side view in FIG. 14. The side view shows damping ring 76 unrolled along circumferential direction 36, i.e., a cylindrical projection.

Illustrated damping ring 76 includes eight identical beads 77. Centers of gravity 37 of beads 77 are located on a planar circular line 38 in plane E, which is perpendicular to longitudinal axis 5. Beads 77 have the shape of a spheroid. The rotational axis of beads 77 is tangential to circular line 38. Dimension 78 of beads 35 along circumferential direction 36 is greater than their diameter 79 in the radial direction. The ratio is approximately 3:2.

Front end side 80 and rear end side 81 of damping ring 76 are essentially formed by front end sides 82 of beads 77 and by rear end sides 83 of beads 77, respectively. Front sides 82, 83 are spherical-cap-shaped or dome-shaped in accordance with the shape of beads 77. Front sides 82, 83 are inclined along circumferential direction 36 in relation to plane E. Inclination 48 changes continuously along circumferential direction 36. A cord diameter of damping ring 76 varies continuously along circumferential direction 36 and has diameter 79 of beads 35 as the maximum. In the transition area, a radius of curvature is preferably continuously in the range between half and twice diameter 79.

Beads 35 rest on both sides with their front end sides 82 and their rear end sides 83 on seat 27 and on protective disk 29. Resting contact surfaces 85, 86 and exposed areas 87, 88 behave under an external force as described in the first exemplary embodiment.

The number of beads 77 is by way of example. The ratio of longitudinal dimension 78 of beads 35 to their diameter 79 is preferably in the range between 2:1 and 1:1.

What is claimed is:

1. A hand-held power tool comprising:

a tool holder for holding a chiseling tool;

a guide tube having an interior;

a striking mechanism including a striking body moved on a longitudinal axis for exerting strikes on the tool in an impacting direction, the striking body moving in the interior of the guide tube;

a damper contacting the striker body to stop the striking body, the damper including a ring made up of a plurality of elastic beads situated circumferentially around the longitudinal axis, the ring made up of the plurality of beads being located within the interior of guide tube, the plurality of beads including identical spherical larger beads and identical spherical smaller beads directly joined to each other, the larger beads being larger than the smaller beads.

2. The hand-held power tool as recited in claim 1 wherein the beads each include a first front side pointing in the impacting direction and a second front side pointing against the impacting direction, at least one of the first and second front sides being inclined in relation to a plane perpendicular to the longitudinal axis.

3. The hand-held power tool as recited in claim 2 wherein the one front side is inclined and ellipsoidal.

4. The hand-held power tool as recited in claim 2 wherein the one front side is inclined and convexly curved.

5. The hand-held power tool as recited in claim 2 wherein centers of gravity of circumferentially adjacent beads are situated at a distance and the one front side is inclined and has a radius of curvature along the circumferential direction around the longitudinal axis, the radius of curvature being between 25% and 100% of the distance.

6. The hand-held power tool as recited in claim 2 wherein a center of the first front side and a second center of the second front side are located on an axis parallel to the longitudinal axis.

7. The hand-held power tool as recited in claim 1 further comprising a machine housing, wherein, under a force effect of the striking body on the damper, a contact surface of one of the first and second front sides rests indirectly or directly on the machine housing and an other contact surface of the other of the first and second front sides rests indirectly or directly on the striking body, the contact surface or the other contact surface increasing with increasing force effect.

8. The hand-held power tool as recited in claim 7 wherein the damper compresses by a spring deflection under the force effect and the contact surface and the other contact surface increases at least proportionally to the spring deflection and is concavely curved.

9. The hand-held power tool as recited in claim 1 wherein, in the case of at least one of the beads, and with regard to cross sections in all planes containing the longitudinal axis, one cross section is maximal and one cross section is minimal, the surface area of the minimal cross section being between 20% and 50% of the surface area of the maximal cross section.

10. The hand-held power tool as recited in claim 1 wherein, in the case of at least one of the beads, with regard to cross sections in all planes containing the longitudinal axis, one cross section is maximal, and the other cross sections are located within the maximal cross section in a cylindrical projection.

11. The hand-held power tool as recited in claim 1 wherein, in the case of at least one of the beads, with regard to cross sections in all planes containing the longitudinal axis, one cross section is maximal and one cross section is minimal, and in a cylindrical projection of the minimal cross section on the maximal cross section, the minimal cross section is located within the maximal cross section and a ring-shaped closed section of the maximal cross section is located outside the minimal cross section.

12. The hand-held power tool as recited in claim 1 further comprising a machine housing, the damper including a stationary seat in the machine housing, the ring resting with one front side along the longitudinal axis on the stationary seat.

13. The hand-held power tool as recited in claim 1 wherein the damper further includes a seat fixed in the guide tube, the ring resting with a front end side of the ring on the seat against the impacting direction.

14. The hand-held power tool as recited in claim 13 wherein the damper further includes a protective disk movable with respect to the guide tube, the protective disk situated between a rear end side of the ring and an anvil.

15. The hand-held power tool as recited in claim 14 wherein the protective disk overlaps in a radial direction with a shoulder of the striking body.

16. The hand-held power tool as recited in claim 15 wherein the protective disk does not overlap in the radial direction with an impacting surface of the striking body.

17. The hand-held power tool as recited in claim 1 wherein the damper only overlaps in a radial direction with a ring-shaped shoulder of the striking body.

18. The hand-held power tool as recited in claim 17 wherein an internal diameter of the damper is larger than a diameter of the striking body at an impacting surface and smaller than a diameter of the striking body at the ring-shaped shoulder.

19. The hand-held power tool as recited in claim 1 wherein the damper includes a seat and a protective disk, the ring being between the protective disk and the seat.

20. The hand-held power tool as recited in claim 19 wherein the seat and the protective disk are located within the interior of guide tube.

* * * * *